US005752856A

United States Patent [19]

Boutin et al.

[11] Patent Number: 5,752,856

[45] Date of Patent: May 19, 1998

[54] SEALED FUSE CONNECTOR

[75] Inventors: Simon Andre Boutin, Montreal; Kazuhiro Goto, Markham, both of Canada

[73] Assignee: The Whitaker Corporation, Wilmington, Del.

[21] Appl. No.: 688,349

[22] Filed: Jul. 30, 1996

[51] Int. Cl.[6] ..... H01R 13/68

[52] U.S. Cl. ..... 439/621; 439/559

[58] Field of Search ..... 439/620, 621, 439/622, 830, 559

[56] References Cited

U.S. PATENT DOCUMENTS

| | | | |
|---|---|---|---|
| 4,335,932 | 6/1982 | Herrmann, Jr. | 339/218 M |
| 4,874,325 | 10/1989 | Bensing et al. | 439/272 |
| 4,940,420 | 7/1990 | Munie | 439/272 |
| 4,973,268 | 11/1990 | Smith et al. | 439/595 |
| 4,997,394 | 3/1991 | Katz et al. | 439/622 |
| 5,088,940 | 2/1992 | Saito | 439/621 |
| 5,227,955 | 7/1993 | Le Bris et al. | 361/395 |
| 5,263,873 | 11/1993 | Landries | 439/271 |
| 5,336,101 | 8/1994 | Kasugai et al. | 439/272 |
| 5,336,102 | 8/1994 | Cairns et al. | 439/272 |
| 5,387,129 | 2/1995 | Hotea | 439/587 |

*Primary Examiner*—Khiem Nguyen
*Assistant Examiner*—Eugene G. Byrd
*Attorney, Agent, or Firm*—Bradley N. Ditty

[57] ABSTRACT

The invention comprises a fuse connector having a housing with a mounting area for receiving fuses therein. The housing has latching arms for securing the housing to an opening in a panel. A cap is to be received over the mounting area. A first seal is disposed between the cap and the housing to prevent moisture from entering the mounting area. A second seal is disposed between the housing and the panel to prevent material from passing through the opening into an opposite side of the panel.

14 Claims, 4 Drawing Sheets

SEALED FUSE CONNECTOR

FIELD OF THE INVENTION

The invention relates to a fuse connector which is sealed against the environment.

BACKGROUND OF THE INVENTION

Fuses of the relatively flat, plug in type which have a fuse link encapsulated in a plastic fuse body with a pair of terminal legs extending from the body have become very popular, especially in automotive applications. The entrance of moisture into the fuse connector, in an extreme situation, can result in current shunting or bypassing and partially defeating the purpose of the fuse. Another disadvantage of the entrance of moisture is the possible corrosion of the metallic terminal legs of the fuse and the female terminal elements of the connector.

U.S. Pat. No. 4,997,394 discloses a water resistant fuse connector. The connector has a body and a cap which provide a seal against moisture. The connector includes terminals which are connected to insulated conductors. The terminals are designed to be electrically connected to the fuse. The body and the cap encompass fuse and the terminals thereby protecting them from moisture.

It would be an advantage to have a sealed fuse connector where the fuses are mounted to a circuit board, the connector is mounted to a panel on a box, and the connector and the box are sealed against the environment.

What is needed is a fuse connector which is mounted on a panel on an enclosure or a box. It is necessary to not only seal the fuse connector, while still allowing access to the fuses to change the fuse in the event that a fuse is blown, but it is also necessary to seal around the fuse connector to prevent moisture from entering the enclosure or box.

SUMMARY OF THE INVENTION

The invention comprises a fuse connector having a housing with a cavity for receiving fuses therein. The housing has latching arms for securing the housing to an opening in a panel. A cap is to be received over the mating cavity. A first seal is disposed between the cap and the housing to prevent moisture from entering the cavity. A second seal is disposed between the housing and the panel to seal the interior of the enclosure.

BRIEF DESCRIPTION OF THE DRAWINGS

An embodiment of the present invention will now be described with reference to the accompanying drawings, in which.

DETAILED DESCRIPTION OF THE INVENTION

The present invention comprises a sealed fuse connector which is mounted to a panel on an enclosure or box. The interior of the enclosure is sealed against moisture in the environment by potting material. Furthermore, the fuse box is sealed against moisture in the environment to not only protect the fuses, but also to prevent moisture from getting inside of the enclosure. The enclosure is typically filled with potting material to keep moisture away from the electronics within. It is necessary that the fuse connector provide a seal to keep the potting material within the enclosure. The fuse connector allows access to the fuses so that a fuse can be changed in the event that one of the fuses is blown. The connector also provides for sealing in addition to the accessibility to the fuses.

Figure 1:
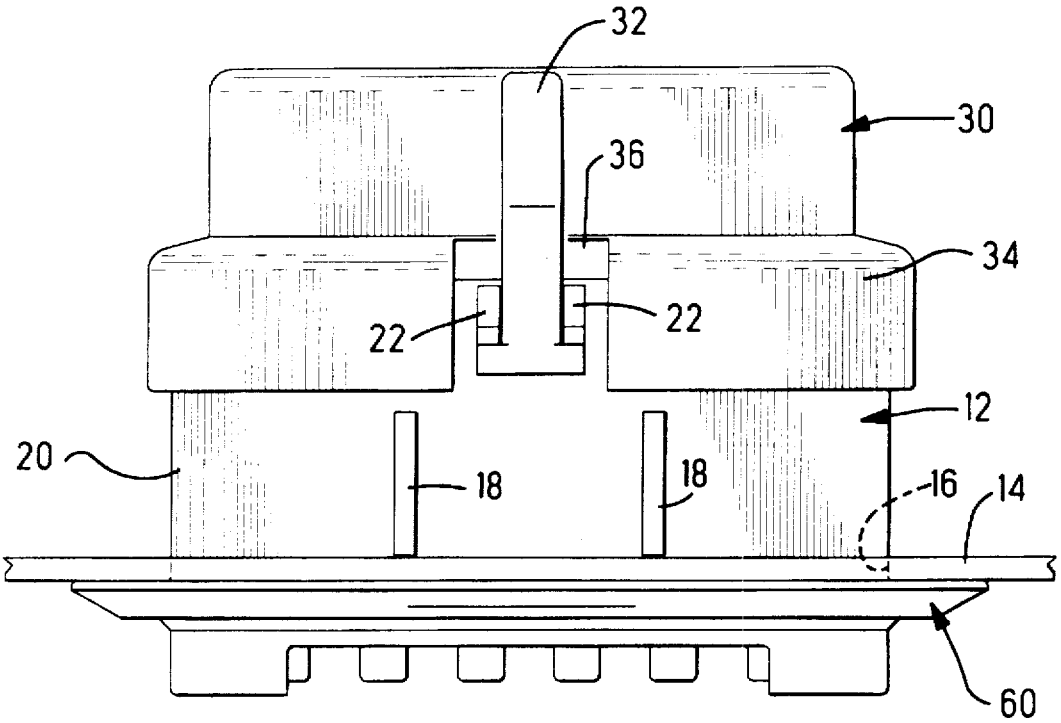
FIG. 1 is a side view of the fuse connector of the present invention.

FIG. 1 shows a side view of the fuse connector 10 of the present invention. The fuse connector has a main housing 12 which is mounted to the panel 14 of an enclosure. The fuse connector 10 is accessible from the outside of the enclosure, but sealing and potting prevents moisture from getting inside the enclosure. The main housing 12 is mounted in an opening 16 in the panel. The main housing 12 has two latch arms 18 along each side 20, see FIGS. 1 and 2. The latch arms 18 are used to secure the main housing 12 to the panel 14 as will be described more fully later. The main housing has latching protrusions 22 along each side 20 for securing the cap 30 thereto, see FIGS. 1 and 2. A flange 24 extends around the periphery of the main housing 12, see FIG. 2. The flange 24 and the latch arms 18 cooperate to mount the fuse connector to the panel.

The fuse connector 10 also has a cap 30 which covers the main housing 12. The cap 30 has a latching arm 32 to secure the cap 30 to the main housing 12. The cap has an overhang 34 which extends around the periphery of the cap. The overhang 34 has two recesses 36, one on each side of the cap 30, only one of which is shown in FIG. 1, through which the latching arm 32 extends to engage protrusions 22 on the main housing 12.

Figure 2:
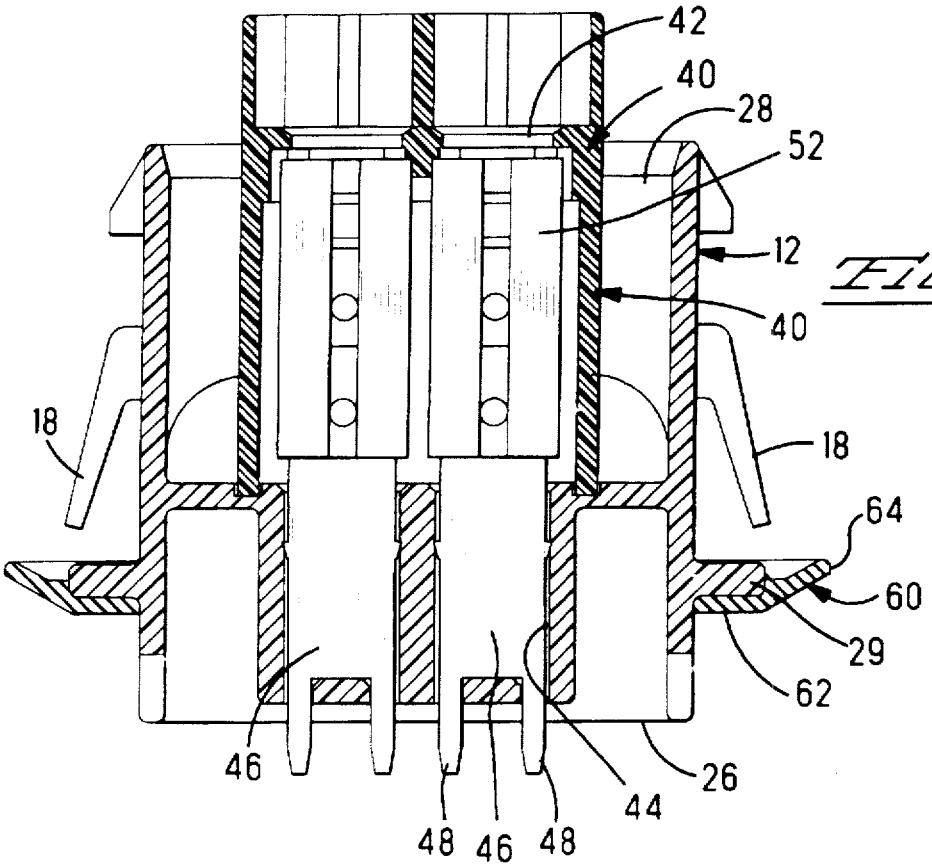
FIG. 2 is a cross sectional view of the main housing of the fuse connector.

FIG. 2 shows a cross sectional view of the main housing 12. The main housing 12 has a mounting face 26 and a cavity 28 on the opposite side of the main housing 12. Mounted inside the cavity 28 is a secondary housing 40 with passages 42 extending therethrough. The main housing 12 has contact receiving passages 44 which extend from the mounting face 26 into the cavity 28 and are aligned with passages 42 in the secondary housing. The main housing 12 has two passages 44 for each of the fuses to be installed within the fuse connector 10. The secondary housing 40 is secured to the main housing 12 within the cavity 28.

Disposed within the contact receiving passages 44 are tab contacts 46. The tab contacts 46 have solder tabs 48 which are received within holes 82 in a circuit board 80. The tab contact 46 has a tab 50 for engaging another contact.

Figure 3:
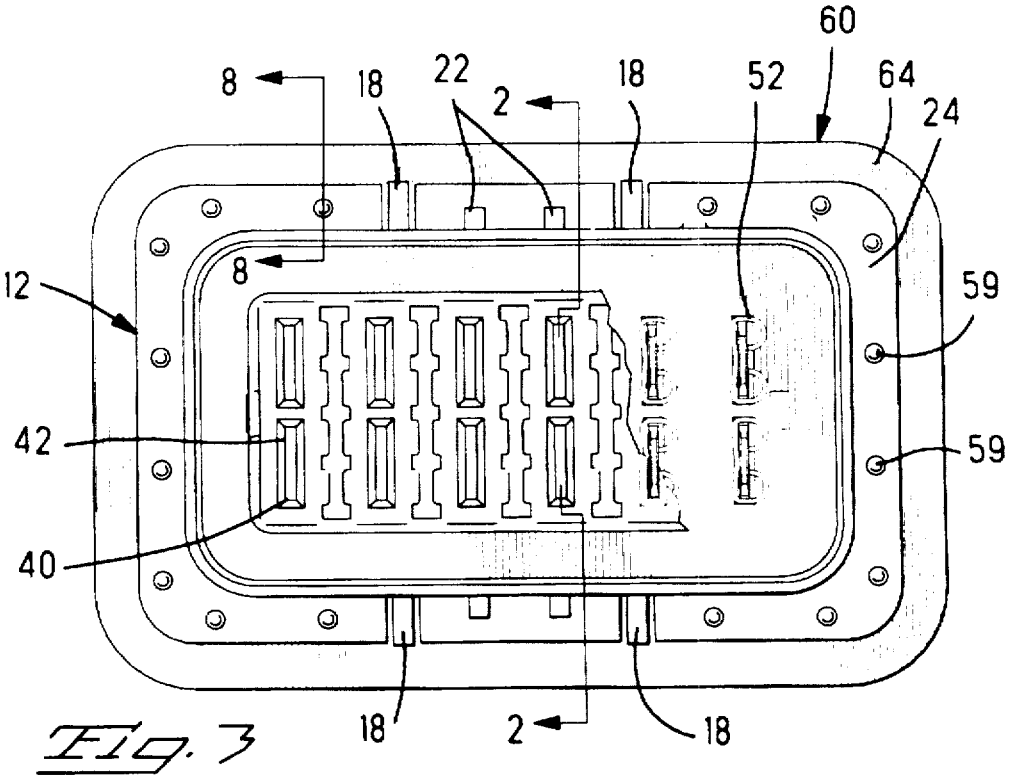
FIG. 3 is a top view of the main housing of the fuse connector, showing a partial cross section to show the details of the connector.

Disposed within passages 42 are tab to tab contacts 52 for providing electrical connection between the tab contacts 46 and the tabs on the fuse, not shown. The tab to tab contact 52 has rolled over edges 52 which has openings on both ends for receiving tab contacts into either end of the tab to tab contact 52. FIG. 3 shows a top view of the main housing 12 in which the top of the tab to tab contact 52 is shown. The tab to tab contact 52 has rolled over edges which form a central recess for receiving a tab therein. The tab contacts 46 and the tab to tab contacts 52 provide electrical connection between the fuses that are installed within the fuse connector and the circuit board.

FIG. 3 shows that the fuse connector is designed to receive six fuses in a side by side relationship. The connector 10 can be utilized either using some or all of the spaces available for mounting fuses.

The main housing 12 has a flange seal 60 which is disposed about the flange 24 around the periphery of the main housing 12. The flange seal is made from a flexible elastomeric material. The flange seal has an engaging portion 62 which secures the seal to the flange 24 and an extension 64. When the main housing 12 is mounted to a panel, the extension will engage the panel and create a seal around the opening 16 of the panel to prevent potting material from escaping from the interior of the enclosure. The potting material will seal the interior of the enclosure against moisture from the environment and protect the components mounted to the interior of the enclosure.

The main housing 12 is mounted to the panel 14 by inserting through the opening 16. The latch arms 18 will deflect from their normal position to allow the passage of the main housing 12. Once the main housing is received in the proper position, the latch arms will resile to their normal position and engage the outside wall of the panel 14. The flange 24 will be pressed against the inside wall of the panel, thereby securing the main housing to the panel 14. The extension 62 of the flange seal will engage the inside wall of the panel 14 thereby forming a seal around the opening.

The use of the flange seal 60 allows for inaccuracy in the placement of the fuse connector within the opening. If the fuse connector 10 is displaced from side to side along the panel 14, the flange seal 60 will still provide a seal around the connector because the seal engages the inner wall of the panel and will move from side to side with the connector. Often, the panel will have many connectors mounted therealong and it is necessary to provide for the inaccuracies in the manufacturing process for the panel and the interior components of the enclosure.

The cap 30 will now be further described with reference to FIG. 4. The cap has a hollow interior 72 for receiving mounted fuses therein when the fuse connector is fully assembled. The cap 30 has side walls 74 from which the latching arms 32 and the overhang 34 extend. The overhang 34 creates a niche 76 which extends around the cap 30. Inside the niche 76 is a shoulder 78. A seal 90 is disposed in the niche 76, against the side walls 74 of the cap 30. The seal 90 is a flexible elastomeric material. The seal has ribs along both the inner and the outer surface to provide a good sealing relationship between the cap 30 and the main housing 12. The seal 90 rests against the shoulder 78 to keep the seal in the correct position.

Figure 4:
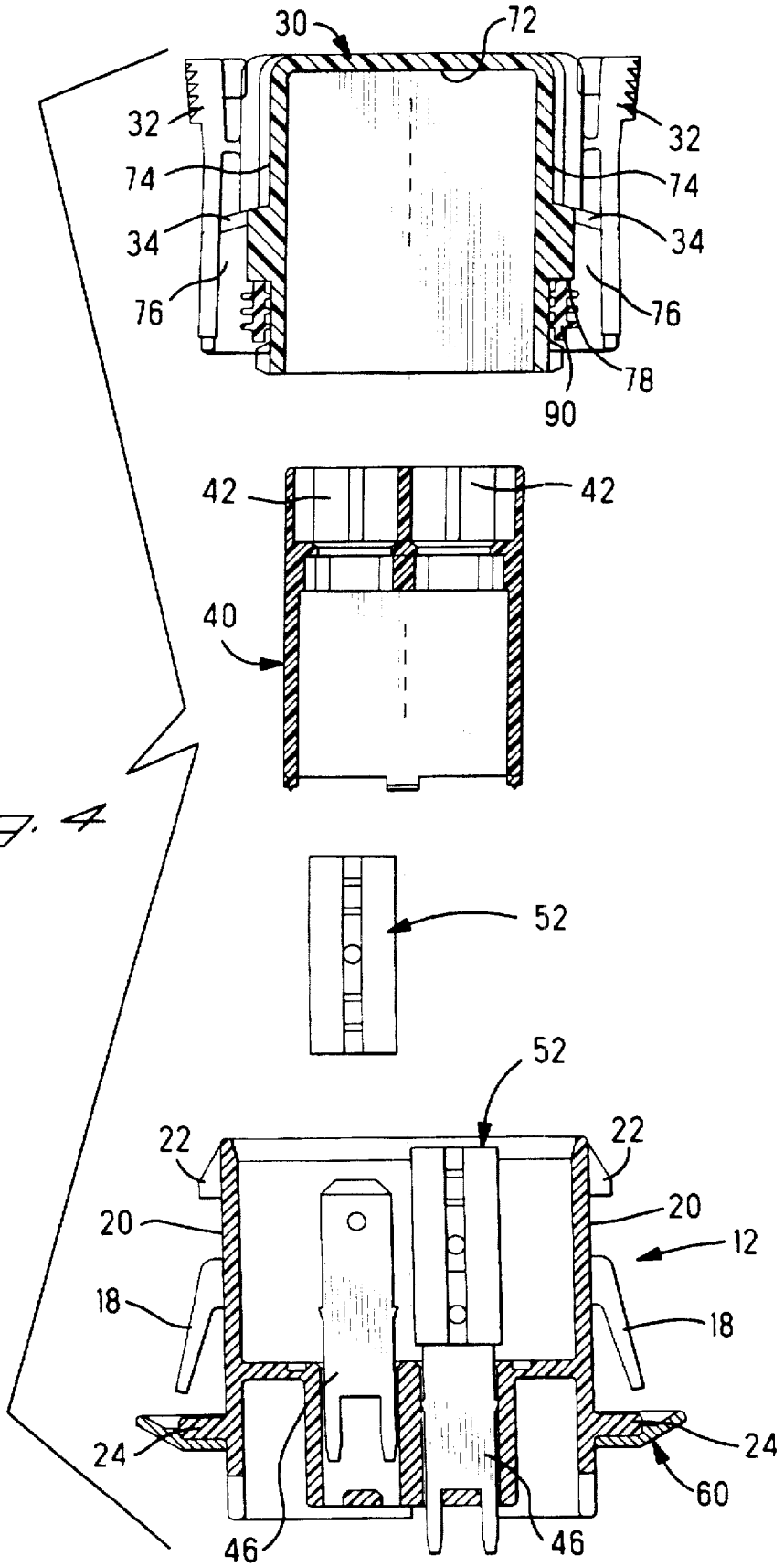
FIG. 4 is an exploded cross section of the main housing and the cap.
Figure 5:
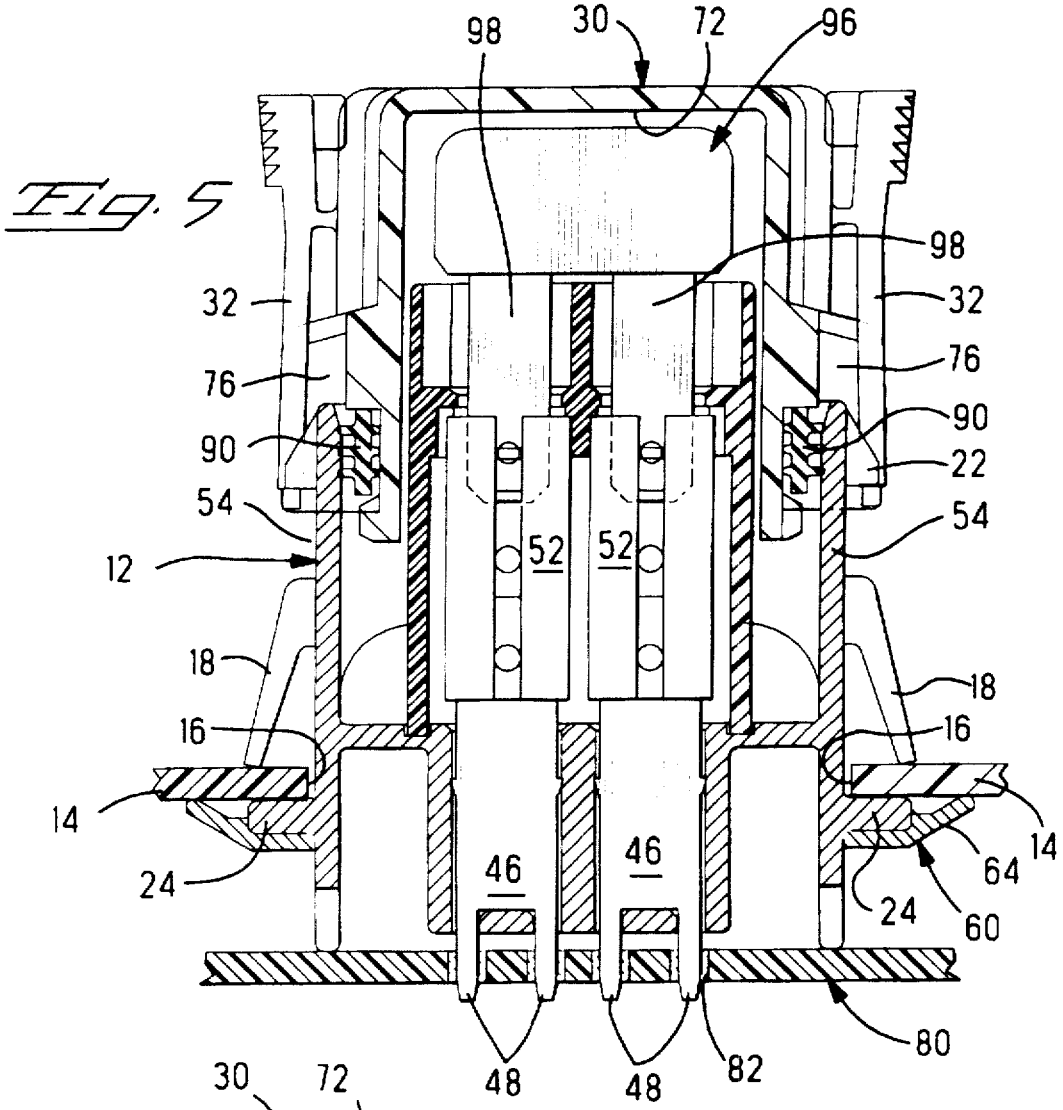
FIG. 5 is a cross sectional view showing the assembled connector with a fuse mounted therein.
Figure 6:
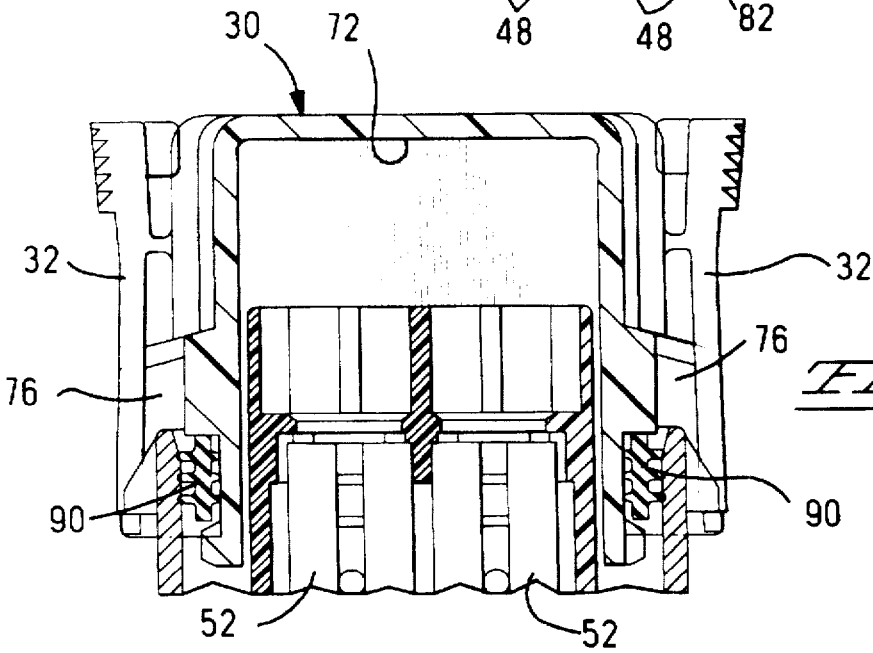
FIG. 6 is a cross sectional view of the assembled connector without the fuse.

FIG. 4 shows the assembly of the fuse connector 10. The tab contacts 46 are received within the contact receiving passages 44. The tab to tab contacts 52 are received over the tab 50 and the secondary housing 40 is received over the tab to tab contacts 52. The main housing 12 is then mounted to the circuit board 80 and the solder tabs 48 are mounted in the holes 82 and then soldered to the traces on the circuit board 80. The main housing 12 is then secured to the panel, as is shown in FIG. 5. Potting material is injected into the interior of the enclosure. Fuses 96 can then be connected to the fuse connector 10 by having the tabs 98 on the fuses received within the tab to tab contacts 52.

The cap 30 is then received over the main housing to cover the fuses, not shown, within the cap 30. Walls 54 of the main housing are received within the niche 76 formed from the overhang 34. The seal 90 is received along the interior of the walls 54 thereby forming a seal around the junction of the main housing 12 and the cap 30. The latching arm 32 engages the protrusions 22 on the main housing to secure the cap 30 to the main housing.

The combination of the flange seal 60 and the seal 90 provide weather proofing for both the fuse connector and the interior of the enclosure. To add, remove, or replace a fuse within the connector, it is only necessary to remove the cap 30 by deflecting the latching arms 32 away from the protrusions 22. The cap 30 can then be reassembled to the main housing 12 and the seal 90 will again provide weather proofing for the connector.

Figure 7:
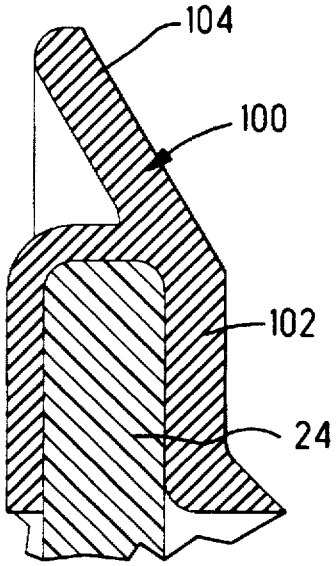
FIGS. 7 and 8 are cross sectional views showing alternative embodiments of the flange seal.
Figure 8:
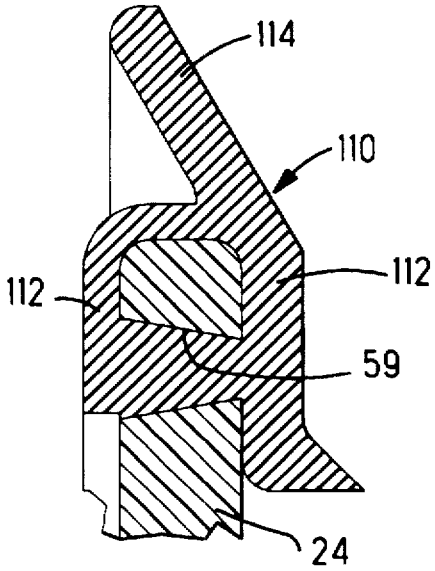

FIGS. 7 and 8 show alternative embodiments of the flange seal 60. In FIG. 7, the flange seal 100 has mounting portion 102 and extension 14. The flange seal 100 is designed to extend around the flange 24, thereby securing the seal 100 to the flange 24. The flange 24 has holes 59 extending therethrough. The flange seal 110, shown in FIG. 8 has a mounting portion 112 and an extension 112. The flange seal 110 is molded to extend through the holes 59, thereby better securing the seal to the flange.

The advantages of the present invention are that the fuse connector can be mounted along a panel of a box so that it is accessible to the outside of the box. The operator can then easily locate, remove and replace a bad fuse. The seals protect not only the fuses and the fuse connectors from moisture, but the flange seal keeps the potting material within the enclosure so that the potting material can provide protection for the interior of the enclosure.

The fuse connector of the present invention and many of its attendant advantages will be understood from the foregoing description. It is apparent that various changes may be made in the form, construction, and arrangement of parts thereof without departing from the spirit or scope of the invention or sacrificing all of its material advantages.

What is claimed is:

1. A fuse connector, comprising:

a housing having a mounting area for receiving fuses therein, the housing having latching arms for securing the housing to an opening in a panel;

a cap to be received over the mounting area;

a first seal disposed between the cap and the housing to prevent moisture from entering the mounting area; and a second seal disposed between the housing and the panel to seal and prevent material from passing through the opening.

2. The fuse connector of claim 1, wherein the housing has tab contacts mounted therein, a rolled over contact provides electrical connection between the tab contacts and tabs on the fuse.

3. The fuse connector of claim 2, wherein the tab contacts have solder posts to be received within holes in a circuit board to provide electrical connection between the circuit board and the fuse.

4. The fuse connector of claim 2, wherein the tab contacts are mounted to a circuit board, the circuit board being disposed along an inner side of the panel, the panel being a part of a box in which the circuit board is mounted.

5. The fuse connector of claim 1, wherein the housing has a flange disposed about the periphery of the housing, the second seal being secured against the flange, the second seal having an extension which completely circles the housing and extends outwardly from the flange, the extension engages an inner side of the panel to prevent material from going through the opening.

6. The fuse connector of claim 1, wherein the cap has an overhang which extends around the periphery of the cap creating a recess between the overhang and side walls of the cap, the first seal being disposed within the recess for engagement with inner walls of the main housing when the cap is installed to the housing.

7. The fuse connector of claim 6, wherein the cap has a latching arm and the housing has a latching protrusion, the latching arm engaging the latching protrusion to secure the cap to the housing.

8. A fuse connector, comprising:

a main housing having a mounting region for mounting fuses therein, the main housing having mounting arms for securing the main housing within an opening on an enclosure, contacts being disposed within the main housing to provide electrical connection from the fuses to inside the enclosure;

a cap to cover the mounting region;

a cap seal being disposed between the cap and the main housing to seal the mounting region against the environment; and a flange seal mounted to the main housing to provide a seal between the main housing and the enclosure.

9. The fuse connector of claim 8, wherein the housing has tab contacts mounted therein, a rolled over contact provides electrical connection between the tab contacts and tabs on the fuse.

10. The fuse connector of claim 9, wherein the tab contacts have solder posts to be received within holes in a circuit board to provide electrical connection between the circuit board and the fuse.

11. The fuse connector of claim 9, wherein the tab contacts are mounted to a circuit board, the circuit board being disposed along the inside of the enclosure.

12. The fuse connector of claim 8, wherein the housing has a flange disposed about the periphery of the housing, the second seal being secured against the flange, the second seal having an extension which completely circles the housing and extends outwardly from the flange, the extension engages an inner side of the enclosure to prevent material from going through the opening.

13. The fuse connector of claim 8, wherein the cap has an overhang which extends around the periphery of the cap creating a recess between the overhang and side walls of the cap, the first seal being disposed within the recess for engagement with inner walls of the main housing when the cap is installed to the housing.

14. The fuse connector of claim 13, wherein the cap has a latching arm and the housing has a latching protrusion, the latching arm engaging the latching protrusion to secure the cap to the housing.

* * * * *